US006408928B1

(12) United States Patent
Heinrich et al.

(10) Patent No.: US 6,408,928 B1
(45) Date of Patent: Jun. 25, 2002

(54) PRODUCTION OF FOAMABLE METAL COMPACTS AND METAL FOAMS

(75) Inventors: Peter Heinrich, Germering; Heinrich Kreye, Hamburg, both of (DE)

(73) Assignee: Linde Gas Aktiengesellschaft, Höllriegelskreuth (DE)

( * ) Notice: Subject to any disclaimer, the term of this patent is extended or adjusted under 35 U.S.C. 154(b) by 0 days.

(21) Appl. No.: 09/658,264

(22) Filed: Sep. 8, 2000

(30) Foreign Application Priority Data

Sep. 8, 1999 (DE) ..... 199 42 916

(51) Int. Cl.[7] ..... B22D 23/00
(52) U.S. Cl. ..... 164/46; 164/79
(58) Field of Search ..... 164/46, 79

(56) References Cited

U.S. PATENT DOCUMENTS 3,087,807 A 4/1963 Allen et al. ..... 75/20
3,940,252 A * 2/1976 Niebylski et al.
5,151,246 A 9/1992 Baumeister et al. ..... 419/2
5,302,414 A 4/1994 Alkhimov et al. ..... 427/192

FOREIGN PATENT DOCUMENTS

DE 2112751 * 10/1972
DE 40 18 360 C1 6/1990

* cited by examiner

*Primary Examiner*—Kuang Y. Lin
(74) *Attorney, Agent, or Firm*—Crowell & Moring LLP

(57) ABSTRACT

A compact body is made by thermal spraying by high-velocity flame spraying or by cold-gas spraying. By heating the compact body to a temperature equal to or preferably above the breakdown temperature of the blowing agent, followed by cooling, porous hollow bodies or metal foams are produced.

12 Claims, 2 Drawing Sheets

PRODUCTION OF FOAMABLE METAL COMPACTS AND METAL FOAMS

BACKGROUND AND SUMMARY OF THE INVENTION

This application claims the priority of German patent document 199 42 916.2, filed Sep. 8, 1999, the disclosure of which is expressly incorporated by reference herein.

The present invention relates to a method for producing foamable metal compacts. A compact body is produced from a powder mixture comprising (1) at least one powdered metal; and (2) at least one blowing agent in powder form which yields gas when heated to a temperature equal to or above the breakdown temperature of the blowing agent.

The present invention furthermore relates to an apparatus for producing expandable metal, comprising (1) means for feeding a powder mixture containing at least one metal powder and at least one blowing agent in powder form; (2) means for producing a compact body from the powder mixture; and (3) means for heating the compact body to a temperature equal to or above the breakdown temperature of the blowing agent.

The present invention also relates to the metal foams obtained from the foamable metal bodies, also as a component of moldings and laminates.

The industrial production of metal foams or porous metal bodies has long been known. For example, in U.S. Pat. No. 3,087,807 a method for producing metal foams is described. A metal powder is mixed with a blowing agent and compacted cold under a pressure of greater than 80 MPa and then transformed by extrusion so that the particles are tightly bonded together (i.e., welded). The temperature during the extrusion must be below the breakdown temperature of the blowing agent. The extruded rod is then heated in a mold to at least the melting temperature of the metal. The rod is thus expanded to form a porous metal body. The foaming can be done in various ways, so that the finished porous metal body has the desired shape.

In German Patent DE 40 18 360 C1, a production process for porous metal bodies is disclosed wherein at least one metal powder and at least one blowing agent in powder form are mixed together and the mixture is shaped by hot compaction to a half-product. To foam the half-product, it is then heated to a temperature above the breakdown temperature of the blowing agent, preferably in the temperature range of the melting point of the metal. Then, a cooling of the body thus expanded takes place.

In German Patent DE 41 01 630 C2, a method for manufacturing foamable metal bodies is disclosed, in which the temperature is made so high during the compacting process that the bond between the individual metal powder particles is formed by diffusion, and the pressure is made so high during the hot compaction that the expansion of the blowing agent is prevented.

The known methods are still not satisfactory in every respect, and especially the range of variation that is available is not satisfactory.

The present invention is addressed to the problem of devising a method and an apparatus of the kind described above, by which the production of foamable metal bodies is simplified and/or the variability in the production of foamable metal bodies is increased.

This problem is solved by the method of the present invention wherein the production of the compact body is performed by the thermal spraying of the powder mixture by high-velocity flame spraying or cold-gas spraying.

The problem is solved by the apparatus of the present invention wherein the means for the production of the compact body from the powder mixture include an apparatus for thermal spraying by high-velocity flame spraying or by cold-gas spraying.

Other objects, advantages and novel features of the present invention will become apparent from the following detailed description of the invention when considered in conjunction with the accompanying drawings.

DETAILED DESCRIPTION OF THE INVENTION

Figure 1:
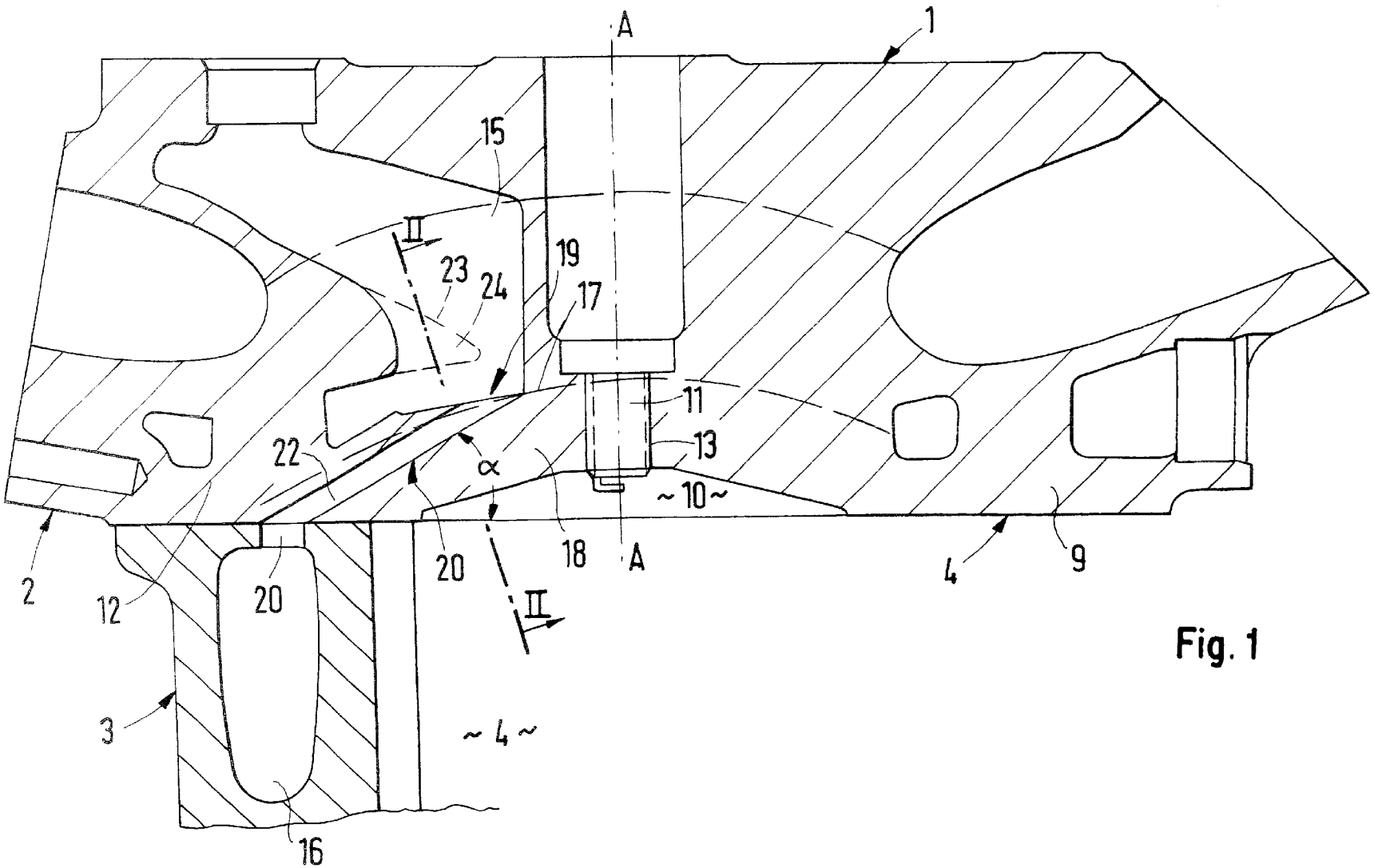
FIG. 1 is a schematic representation of an apparatus for the production of metal foams according to the present invention.

Thermal spraying processes are characterized essentially by the fact that they make it possible to apply uniform coatings of high quality. Coatings applied by thermal spraying methods can be adapted to various requirements by varying the spray materials and/or the process parameters. The spray materials can basically be in the form of wires, rods, or powder. A post-treatment can also be provided.

Details on thermal spraying are to be found, for example, in European Standard EN 657.

A variant of thermal spraying that has been known for some time is high-velocity flame spraying, sometimes also called HVOF (high-velocity oxy-fuel).

In recent times, an additional thermal spraying process has been developed, which is called cold-gas spraying. This is a further development of high-velocity flame spraying. This process is described, for example, in European Patent EP 0 484 533 B1. In cold-gas spraying, an additive in powder form is used. The powder particles in cold-gas spraying, however, are not melted in the gas stream. Instead, the temperature of the gas stream is lower than the melting point of the additive powder particles. In the cold-gas spraying process, therefore, a gas that is "cold" in comparison to the conventional spraying processes, or a comparatively colder gas, is used. Nevertheless, the gas is heated the same as in the conventional methods, but as a rule only to temperatures below the melting point of the powder particles of the additive material.

Depending on the thermal spraying process, high-velocity flame spraying or cold-gas spraying, the result is a compact body with specific properties. The high-velocity flame spraying process can be the high-velocity flame spraying method of the first and second generation with spray particle velocities of 400 to 500 m/s. The spray particle velocities were measured on a WC—Co spray powder having a grain size of −45 $\mu$m+10 $\mu$m (i.e., the particles passed through a sieve having an aperture size of the square holes of 45 $\mu$m, but did not pass through a sieve having an aperture size of the square holes of 10 $\mu$m). Ninety percent of the particles have a grain diameter of 10 to 45 $\mu$m. Preferably, the high-velocity flame spraying is of the third generation with spray particle velocities of 500 to 700 m/s (measured on a WC—Co spray powder with a grain size of −45 $\mu$m+10 $\mu$m). In the cold-gas spraying process, the powder particles can be accelerated to a velocity of 300 to 1600 m/s. Powder particle velocities between 500 and 1200 m/s are especially suitable for obtaining especially great coating efficiencies and coating densities.

Any appropriate metallic spray powders can be used as materials for the metal powder, especially:

(1) pure metals;

(2) metal alloys;

(3) metals and/or metal alloys with the addition of hard substances such as metal oxides (especially $Al_2O_3$ and/or $TiO_2$), carbides, borides and/or with the addition of synthetic substances; or (4) mixtures of the above substances.

According to the present invention, metal powder is processed together with a powder containing a blowing agent by high-velocity flame spraying or cold-gas spraying to form a compact body. The compact body can be in the form of a coating or a shape. Due to the short residence time of the powder in the heated carrier gas stream (usually in the range of a few milliseconds) during high-velocity cold-gas spraying, the blowing agent remains at least substantially bound. If desired, it does not become free to blow until the subsequent heating occurs. It is crucial in the technical spraying process that the blowing agent powder gives off virtually no gas during the spraying process. In the case of cold-gas spraying, this is assured not only by the brief residence time of the powder, but also by the low process temperature of cold-gas spraying using a stream of carrier gas heated to a few hundreds of degrees Celsius. Cold-gas spraying is therefore preferably used.

The present invention makes available an easily practiced and versatile process for the production of foamable metal bodies. When the metal bodies thus produced are heated to a temperature equal to or preferably above the breakdown temperature of the blowing agent followed by cooling, they can be used for the production of porous metal bodies or metal foams. As a rule, the breakdown temperature of the blowing agent is not a sharply defined temperature but rather a range of temperatures. In the scope of the present invention, therefore, a temperature equal to or preferably above the breakdown temperature of the blowing agent is a temperature in the breakdown temperature range or preferably above the breakdown temperature range of the blowing agent.

In the method of the present invention, the powder mixture of metal plus blowing agent can be sprayed in virtually any ratio of admixture. This makes it possible to adapt the ratio of admixture of metal powder and blowing agent powder to the desired circumstances.

The mixture of metal powder and blowing agent can be varied in the production of the foamable metal body as regards its parameters as well as its composition, but especially as regards its ratio of admixture. Special advantages result if the powder mixture is sprayed with a varied blowing agent content. By varying the ratio of metal and blowing agent, coatings and structures can be sprayed with a blowing agent content that varies in a defined manner (i.e., graded coatings and structures).

In embodiments the present invention, it has been found that a blowing agent content in the powder mixture between 0.01 and 1.0 wt.-%, preferably between 0.05 and 0.5 wt.-%, and more preferably between 0.1 and 0.3 wt.-%, is appropriate.

In embodiments of the present invention, the outgassing or blowing agent powder includes as blowing agents (1) metal hydrides, such as titanium hydrite ($TiH_2$); (2) carbonates, such as calcium carbonate, potassium carbonate, sodium carbonate or sodium bicarbonate; (3) hydrates, such as aluminum sulfate hydrate, alum, aluminum hydroxide; or (4) easily evaporating substances, such as mercury compounds or powdered organic substances; or (5) mixtures of the above substances.

The powder mixture can be sprayed with advantage onto a substrate support, while a relative movement is produced between the substrate support and the apparatus for the thermal spraying of the powder mixture by high-velocity flame spraying or cold-gas spraying. For example, formed bodies can be sprayed with the powder mixture, while the spray gun of the apparatus for thermal spraying and/or the substrate support, for example, is moved.

The powder mixture can be sprayed according to the present invention onto any suitable substrate, especially onto a support of metal, plastic, ceramic, and/or glass. The compact body can be separated to advantage from the support material before the compact body is expanded by the outgassing of the blowing agent when it is produced by the application of heat.

In an embodiment of the present invention, the compact body can be shaped or transformed by varying the pressure and/or the temperature before the compact body is expanded by the outgassing of the blowing agent. Extrusion or rolling are examples of such transformation.

In another embodiment of the present invention, the powder mixture is sprayed onto the inside of a form which is to be wholly or partially lined with foam. The metal foam is produced by heating to a temperature equal to, or preferably above, the breakdown temperature of the blowing agent.

In another embodiment of the present invention, at least two layers are sprayed. At least one layer is thermally sprayed with a powder mixture including the blowing agent powder, and at least one additional layer with metal powder without the blowing agent. For example, a powder mixture of metal and blowing agent can be sprayed only layer-wise between two metal layers.

By heating the compact which is made by the method described above to a temperature equal to or preferably above the breakdown temperature of the blowing agent, and by subsequent cooling, a metal foam can be produced. Preferably, the compact is heated above the fusion temperature of the metal or above the solid temperature of the metal alloy. In this case, the blowing agent escaping in gaseous form causes the molten metal to foam. After it cools, this foam forms a porous hollow body. Preferably, therefore, the gas released by the breakdown of the blowing agent causes the molten metal or metal alloy to foam up.

Compacts can be made which comprise at least one metal foam. On the other hand, laminates can be made which comprise at least one metal foam as a layer on or between a substrate.

In the case of compacts or laminates, in addition to the at least one foamed metal layer, an additional thermally sprayed layer can be present.

Especially suitable as a blowing agent is titanium hydride ($TiH_2$).

Titanium hydride can be sprayed, for example, by cold-gas spraying together with other metal powders of aluminum (Al), Copper (Cu), nickel (Ni), iron (Pe), titanium (Ti) and alloys which contain one or more of these metals. As a rule, a relatively small amount of the blowing agent suffices to expand the compact. For example, a powder mixture with 0.2 wt.-% of $TiH_2$ increases the volume of Al by more than tenfold.

The gas needed for thermal spraying can contain nitrogen; helium; argon; neon; krypton; xenon; a gas containing hydrogen; a gas containing a hydrocarbon, especially carbon dioxide; oxygen; a gas containing oxygen, air, water vapor; or mixtures of gases. In addition tQ the gases disclosed in EP 0 484 533 B1, a gas containing nitrogen, argon, neon, krypton, xenon, oxygen, a gas containing hydrogen, a gas containing carbon, especially carbon dioxide, water vapor, or mixtures of the aforesaid gases and mixtures of these gases with helium, are also suitable as the gas bearing the additive in powder form. The helium content of the total gas can be up to 90vol.-%. A helium content of 10 to 50 vol.-% is preferred in the gas mixture.

An embodiment of an apparatus according to the present invention is shown in FIG. 1, which shows a gas inlet 1 (for example, nitrogen, helium, pressurized air); a gas heater 2; a powder feeder 3; and spray gun 4 (e.g., cold spray system); a target 5; and an oven 6 for heating the compact body. Using this apparatus, the compact body is produced by spraying a powder mixture onto a target. Instead of using an oven for heating the compact body, autogenous or inductive heating may be used.

Figure 2:
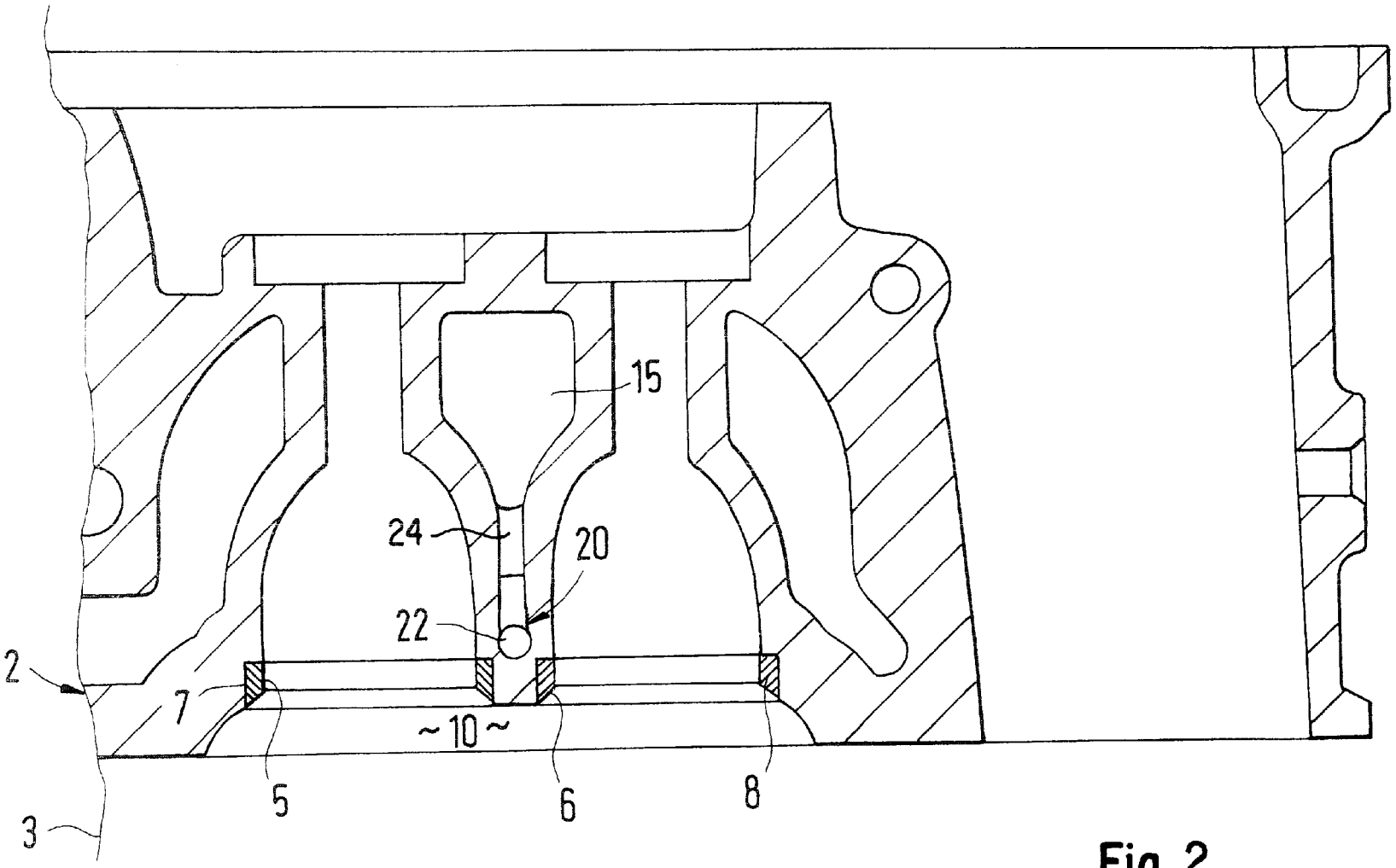
FIG. 2 is a schematic representation of a powder feeder that may be used in the apparatus of FIG. 1.

In an embodiment of the apparatus, the powder feeder for the at least one metal powder and at least one blowing agent in powder form is shown schematically in FIG. 2. The powder feeder may include a vessel 1 filled with a powder mixture; chamber 3; a fixed ring 4; a fixed ring with hole 7; rotating disc 2 with a circular chamber; gas inlet 5; and gas and particle outlet 6.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for the production of foamable metal bodies, comprising:

forming a compact body from a powder mixture that comprises at least one metal powder and at least one blowing agent powder, which produces gas upon heating to a temperature equal to or above a breakdown temperature of the blowing agent, wherein the forming of the compact body is performed by high-velocity flame spraying or by cold-gas spraying.

2. A method according to claim 1, further comprising varying a ratio of the at least one metal powder and the at least one blowing agent powder.

3. A method according to claim 1, wherein the blowing agent content in the powder mixture is between 0.01 and 1.0 wt.-%.

4. A method according to claim 1, wherein the blowing agent content in the powder mixture is between 0.05 and 0.5 wt.-%.

5. A method according to claim 1, wherein the blowing agent content in the powder mixture is between 0.1 and 0.3 wt.-%.

6. A method according to claim 1, wherein the blowing agent powder comprises a blowing agent selected from the group consisting of metal hydrides, carbonates, hydrates, alum, aluminum hydroxide, mercury compounds, pulverized organic substances, and combinations thereof.

7. A method according to claim 1, wherein the forming of the compact body comprises spraying the powder mixture onto a substrate support while a relative movement between the substrate support and an apparatus for the high-velocity flame spraying or cold-gas spraying of the powder mixture takes place.

8. A method according to claim 7, wherein the substrate support material is metal, plastic, ceramic, or glass.

9. A method according to claim 8, further comprising removing the compact body from the substrate support before outgassing of the blowing agent.

10. A method according to claim 1, further comprising shaping the compact body by varying at least one of pressure or temperature before the outgassing of the blowing agent.

11. A method according to claim 1, wherein the powder mixture is sprayed onto the inside of a form that is to be wholly or partially filled with a metal foam.

12. A method according to claim 1, wherein at least two layers are sprayed, at least one layer being thermally-sprayed with the powder mixture comprising the at least one metal powder and the at least one blowing agent powder, and at least one additional layer being a metal powder without a blowing agent.

* * * * *